US005363789A

United States Patent [19]

Laurie et al.

[11] Patent Number: 5,363,789

[45] Date of Patent: Nov. 15, 1994

[54] DISCONNECTABLE MOORING SYSTEM

[75] Inventors: Jean-Phillippe R. L. Laurie; René Perratone, both of Menton, France

[73] Assignee: Single Buoy Moorings Inc., Marly, Switzerland

[21] Appl. No.: 120,926

[22] Filed: Sep. 15, 1993

[51] Int. Cl.[5] ..... B63B 21/50

[52] U.S. Cl. ..... 114/293; 441/4

[58] Field of Search ..... 441/3-5; 114/293, 230; 166/352-354; 175/5-7

[56] References Cited

U.S. PATENT DOCUMENTS

| | | | |
|---|---|---|---|
| 3,096,999 | 7/1963 | Ahlstone et al. | 285/24 |
| 3,353,595 | 11/1967 | Nelson et al. | 166/16 |
| 4,124,229 | 11/1978 | Ahlstone | 285/18 |
| 4,209,193 | 6/1980 | Ahlstone | 285/309 |
| 4,265,470 | 5/1981 | Danner | 285/39 |
| 4,337,971 | 7/1982 | Kendrick | 285/315 |
| 4,557,508 | 12/1985 | Walker | 285/84 |
| 4,611,953 | 9/1986 | Owens | 405/224 |
| 4,650,431 | 3/1987 | Kentosh | 441/5 |
| 4,682,559 | 7/1987 | Schnitzer et al. | 114/295 |
| 4,693,497 | 9/1987 | Pettus et al. | 285/12 |
| 4,717,318 | 1/1988 | Nobileau | 285/334 |
| 4,883,293 | 11/1989 | Lawson | 285/364 |
| 4,923,006 | 5/1990 | Hartmann et al. | 166/65.1 |
| 4,984,830 | 1/1991 | Saunders | 285/368 |

FOREIGN PATENT DOCUMENTS 9306001 4/1993 WIPO ..... 441/3

OTHER PUBLICATIONS

Offshore Technology Conference Pub. #6251 May 7-10, 1990.

*Primary Examiner*—Edwin L. Swinehart

*Attorney, Agent, or Firm*—Young & Thompson

[57] ABSTRACT

A disconnectable mooring system for connecting a mooring body member and a receiving member. The receiving member is rotatably arranged in a floating structure and is a part of a turret system. The mooring buoy member is provided with structural connections at its circumference cooperating with corresponding connections on the receiving members. Both the receiving member and the mooring buoy member are provided with fluid passages on the side remote from the sealing interface fixedly connected to fluid conduits and at the interface ending into openings. Around the openings seals are provided. Centering devices are present to locate the mooring buoy member and the receiving member relative to each other. For connecting-disconnecting, it is sufficient to operate the structural connections and to raise or pay out the lifting device.

7 Claims, 7 Drawing Sheets 8
5
6
3
1
2
7
22
23
4
17
18
15
13
11
12
14
16
9
10
10

5
1
4
17
18
15
16
9
10
10

DISCONNECTABLE MOORING SYSTEM

BACKGROUND OF THE INVENTION

Disconnectable mooring systems are used in combination or used to connect floating structures in harsh environment to sub sea structures. Fluid connections are provided in disconnectable mooring system. Connection-disconnection is realized by connection-disconnection of a subsea mooring buoy anchored to the seabed by catenary mooring lines. Fluid conduits from subsea wells extend into the mooring buoy and this mooring buoy is structurally connected to a floating structure, such as a tanker, by means of a hydraulic operated structural connection. On the tanker side a receiving means is provided for the mooring buoy and this receiving means is normally part of a turret structure in the floating structure such that this floating structure can rotate around the mooring buoy member during connection.

In the prior art subsea fluid conduits were slidably arranged in the mooring buoy member. The mooring buoy member and the receiving members were positioned relative to each other so that passages in both the mooring buoy member and the receiving member were aligned and connected with a structural connector. After that conduits were lifted through the passages in both the receiving member and the mooring buoy member and connected (possibly through quick connection means) to fluid conduits within the turret structure of the tanker.

Although this is a very straight forward and simple to realize method for connecting the mooring buoy member to the receiving members and to connect the fluid conduits from the well with conduits from the vessel problems arise during disconnect. During a disconnect situation the risers have to be disconnected and lowered to the mooring buoy member. Thereafter the structural connector can be reactivated to part the mooring buoy member from the receiving member. This is a time consuming operation. Increased disconnect situations, e.g. higher disconnect seastates, require a larger diameter disconnector to cope with the associated higher loads. Also given that the disconnection time should be reduced as much as possible and the number of risers conduits possibly increased connected to the subsea wells a prior art system cannot handle these requirements.

In U.S. Pat. No. 4,650,431 a disconnectable mooring system is described whilst U.S. Pat. Nos. 3,096,999, 3,353,595 and 4,337,971 relate to connectors.

Accordingly it is an object of the invention to provide an improved disconnectable mooring system in which connect-disconnect times can be shortened considerably without taking any risk with regard to safety precautions.

Another aim of the invention is to be able to use one single lifting line to bring the mooring buoy member and receiving member together wherein it is not longer necessary to have a number of separate lines for displaceing the conduits (risers) after connection has been realized.

A further aim of the invention is to realize a simple method of centering the mooring buoy member and the receiving member in a well defined way relative to each other.

SUMMARY OF THE INVENTION

These and other objects of the invention are realized in a disconnectable mooring system comprising a mooring buoy member and a receiving member, said members being connectable to and disconnectable from each other, the mooring buoy member comprising:

at its circumference structural connecting means, within its circumference internally extending fluid passages on one side fixedly connected to subsea fluid conduits and on the other side ending into openings with surrounding sealing means, said other side being the sealing face directed to the receiving member in the connected condition, and centrally disposed lifting means extending in the direction of the receiving member, the receiving member comprising a central passage for receiving the lifting means, and fluid passages on one side fixedly connected to fluid conduits and on the other side ending into openings with surrounding sealing members, said other side being the sealing face directed to the mooring buoy member in the connected condition, in which the sealing means of both the receiving member and the mooring buoy member cooperate to provide a sealing connection of the fluid passages, wherein the receiving member is provided with structural connecting means to cooperate with the structural connecting means of the mooring buoy member, and wherein cooperating centering means are provided on both the receiving member and the mooring buoy member.

In this embodiment the structural connection means can comprise circumferential ribs of the sealing faces of both the receiving member and the mooring buoy member, wherein tiltable latching fingers having a groove to receive both circumferential ribs and actuation members for said fingers.

In one embodiment centering means are provided such that in only one rotational position the receiving member and mooring buoy member can be connected.

According to a preferred embodiment the sealing faces of both the receiving member and the mooring buoy member are flat and substantially perpendicular to the axis of the connect-disconnect movement of the members.

According to a further embodiment the receiving member is provided in each fluid passage with a sleeve member being displaceable in the direction of opening of the fluid member and being provided with sealing means to engage the sealing face of the mooring buoy member.

DESCRIPTION OF THE PREFERRED EMBODIMENTS

Figure 1:
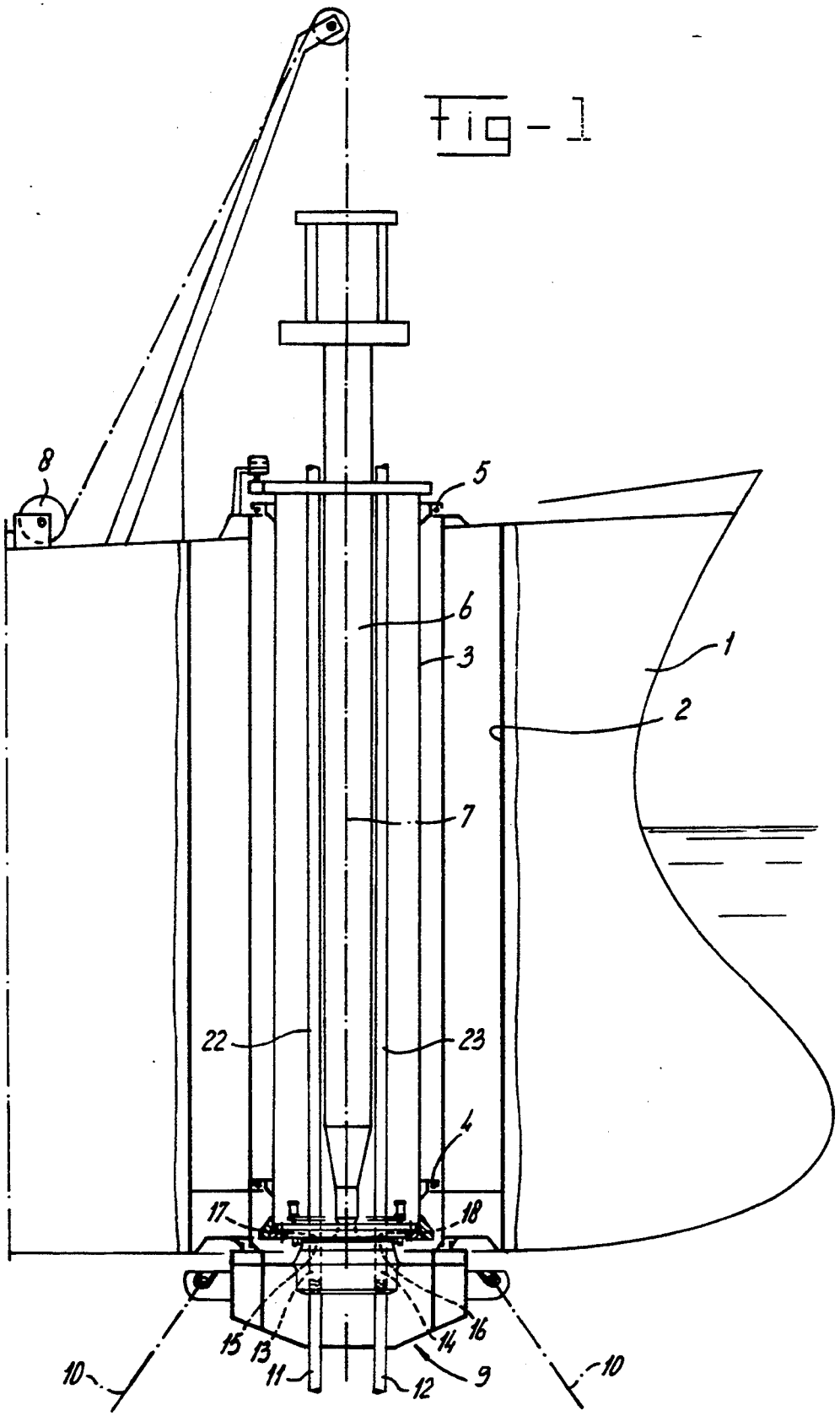
FIG. 1 is a side view of a vessel provided with the disconnectable mooring system according to the invention in its connected condition.

In FIG. 1 only the front part of a vessel 1 is shown. In this front part a turret housing 2 is provided in which a turret 3 is accommodated. Turret 3 is journalled through bearing 4 and 5. Inside turret 3 a guiding passage 6 is provided in which a winch cable 7 extends being connected to a winch motor 8 on the one hand and to a mooring buoy 9 on the other hand. Mooring buoy 9 is provided with anchor chains 10 connected to the seabed. Furthermore conduits 11 and 12, for example connected to a subsea well, are connected to passages 13, 14 respectively in mooring buoy 9 (see also FIG. 3). Passages 13 and 14 end in openings 15 respectively 16 being opposite to openings 17, 18 of passages 19, 20 in receiving member 21 of turret 3. To passages 19 and 20 conduits 22 and 23 are connected which are communication with non-rotatable part of the vessel through a swivel structure which is not further shown.

Figure 2:
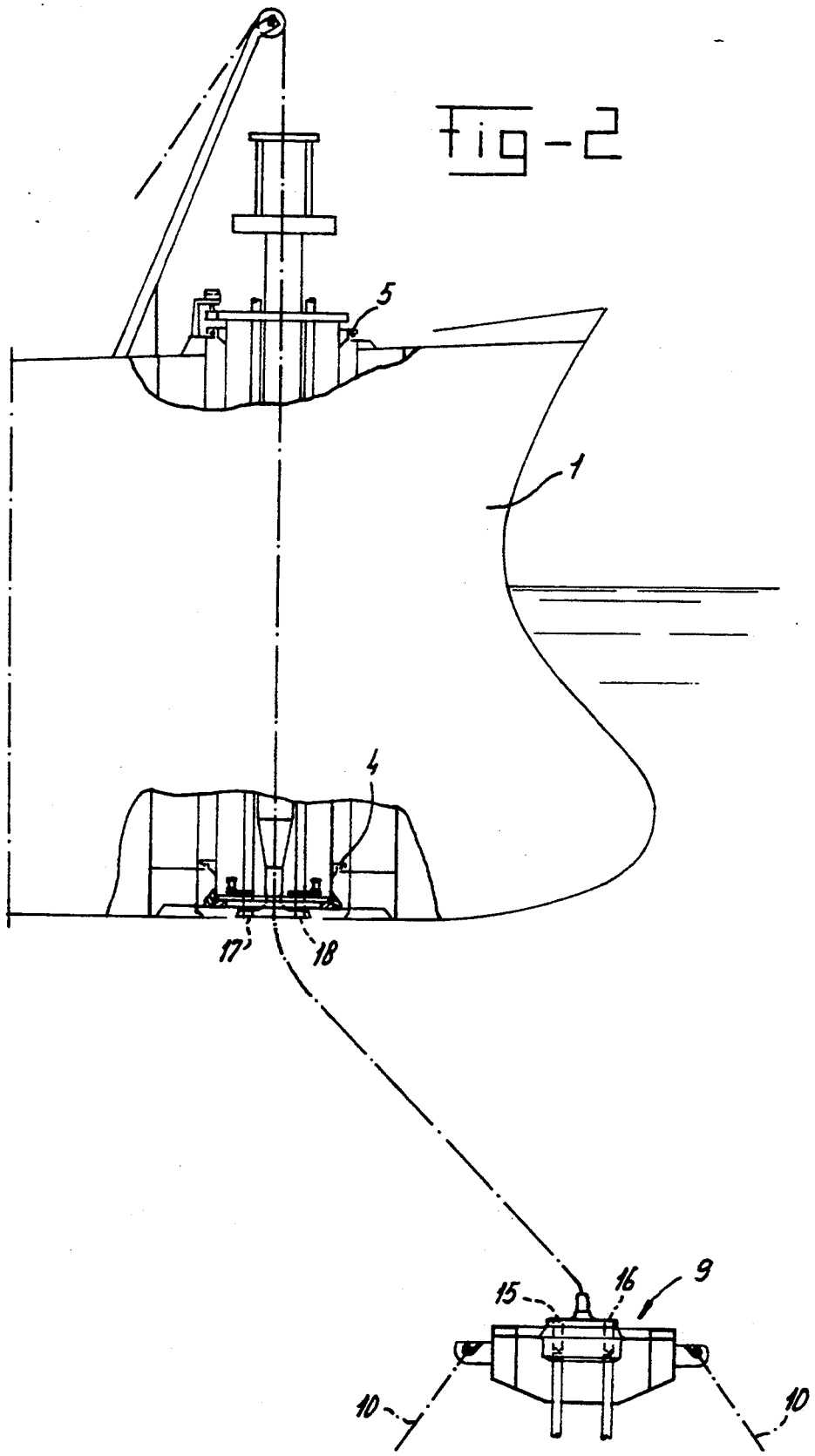
FIG. 2 is the device according to FIG. 1 in its disconnected condition.

In FIG. 1 the condition is shown in which mooring buoy 9 is connected to receiving member 21. In FIG. 2 the condition is shown wherein the mooring buoy is disconnected from receiving member 21 and vessel 1.

Figure 3:
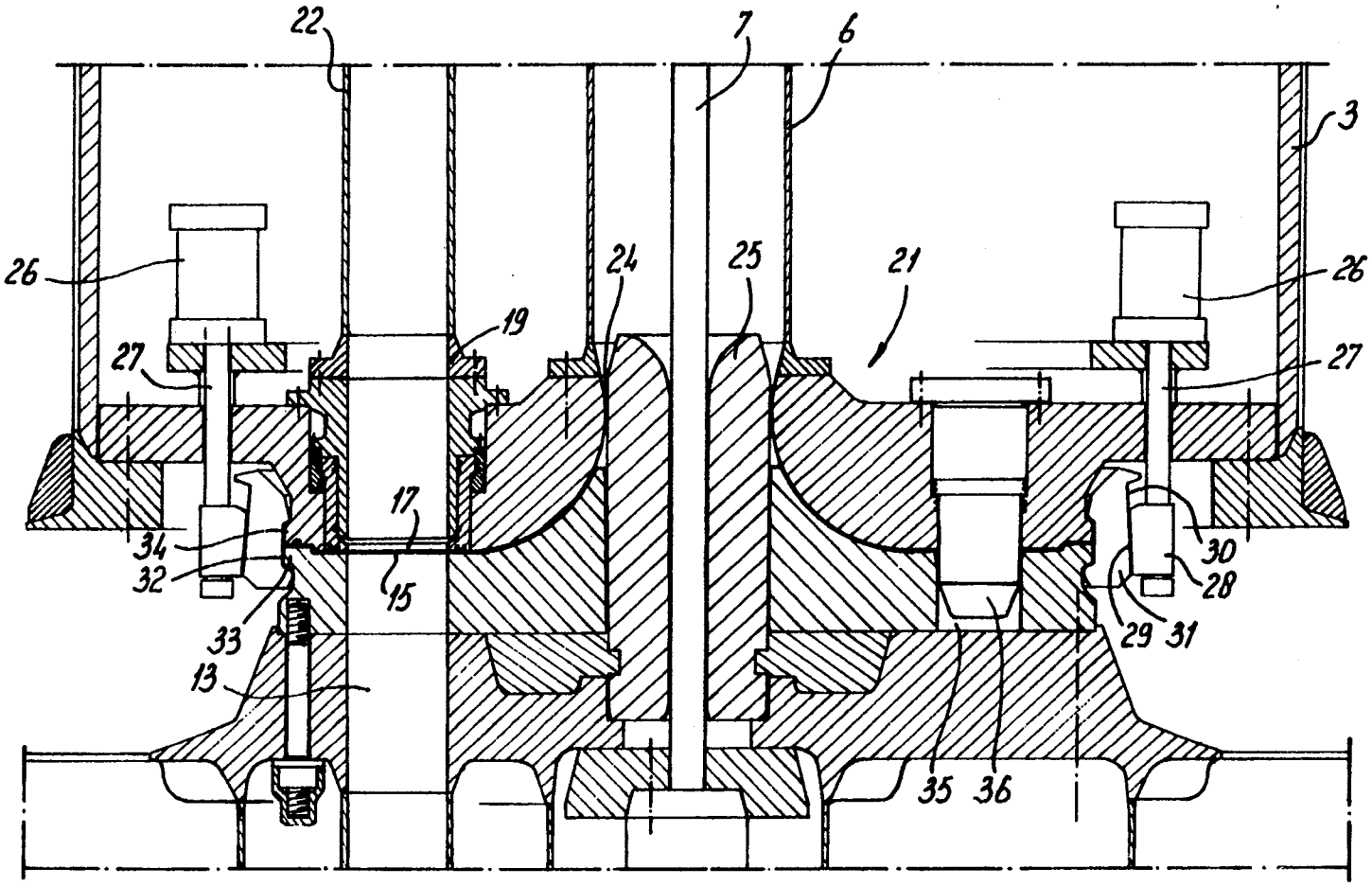
FIG. 3 is a detail of FIG. 1 showing the disconnectable mooring system.

In FIG. 3 details are shown from which the connect-disconnect mechanism is clear. Receiving member 21 is provided with a receiving entry 24 to receive centering projection 25 in which winch cable 7 is accommodated. Actuating rams 26 are provided of which the plunger rods 27 act to an actuating ring 28 having a bevelled inner face 29 cooperating with the external surface 30 of a number of latching fingers 31. These latching fingers are provided with grooves 32 having a dimension to accommodate both circumferential ribs 33, 34 respectively of the receiving member 21 and mooring buoy 9. Inclination of surfaces 29, 30 is such that in the lowered position of actuating ring 28 without actuating of ram 26 it is not possible that plunger rod 27 moves inwardly based on vibration or forces urging to separate parts 9 and 21. Although a single actuating ring is shown it is possible to provide several rings or ring parts being actuated by several circumferentially arranged sets of actuating rams. Mooring buoy 9 is provided with a position definig openign 35 in which a piston 36 provided in receiving member 21 can move. If piston 36 is lowered in opening 35 rotational movement between members 9 and 21 is excluded.

Figure 4:
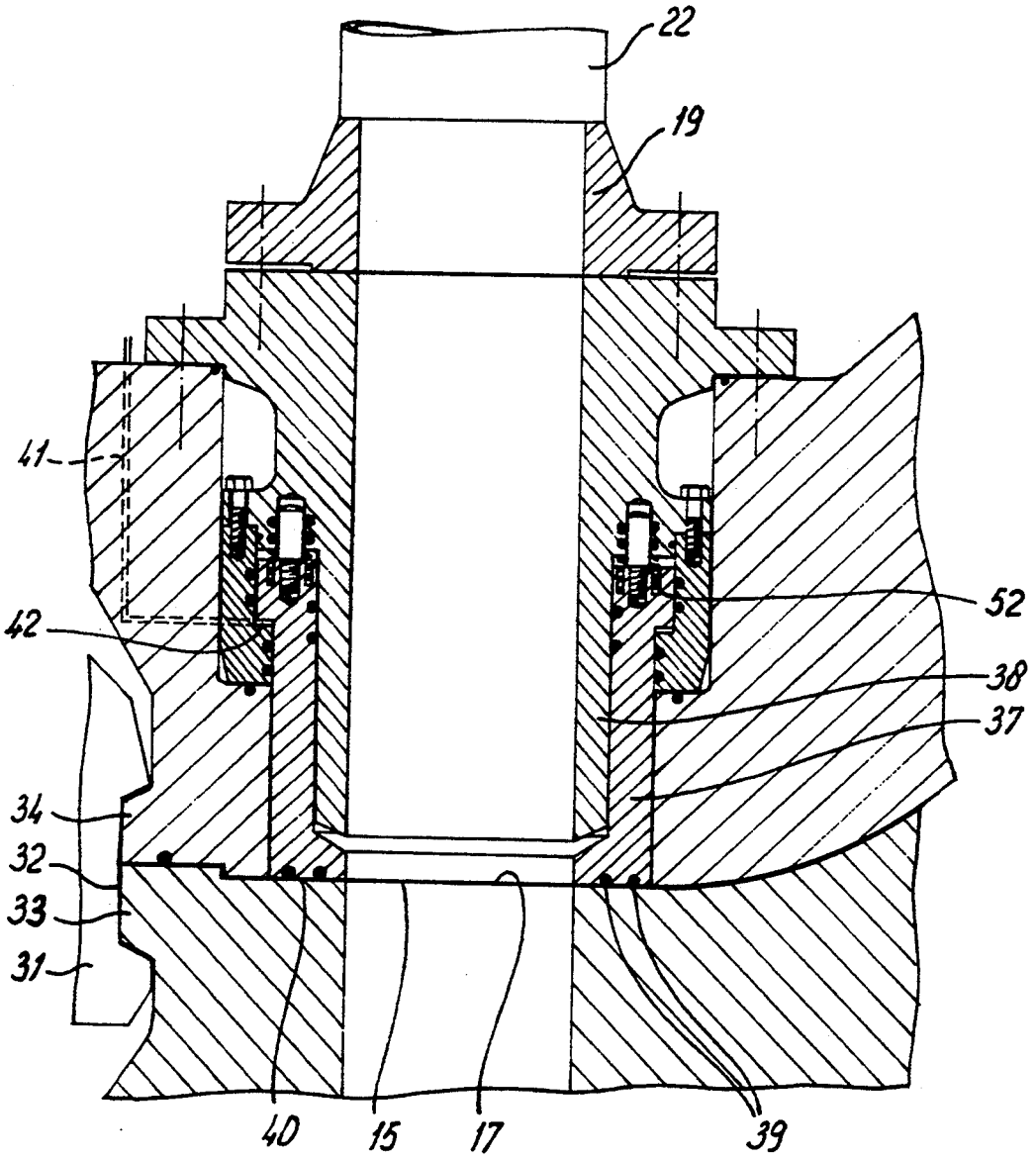
FIG. 4 is a detail of FIG. 3 showing the sealing arrangement for the fluid conduits.

In FIG. 4 the sealing arrangement between openings 16 and 17 is shown. Surrounding passage 19 a sleeve 37 is provided being sealed relative to the lower end 38 of passage 19. Sleeve 37 is provided at its front end with sealing rings 39 to engage sealing face 40 of mooring buoy 9. Hydraulic pressure is admitted through line 41 into space 42.

On the upper side of sleeve 27 spring 52 is provided forcing sleeve 37 in downward direction. This spring provides the sealing force for the rings 39 and to prevent damage during connecting or disconnecting it is possible to move sleeve 37 inwardly by use of oil pressure admitted through conduit 41.

Starting from the position shown in FIGS. 1, 3 and 4 disconnection is realized by removing the pressure from line 41 and subsequently retracting plunger rods 27 such that actuating ring 25 moves to tilt latching fingers 31 such that circumferential rib 34 is not longer enclosed within groove 32 of latching finger 31.

At the same time piston 36 is retracted. At this moment mooring buoy member will be suspended by cable 7. Through paying out this cable 7 complete disconnection can be realized between the vessel and the mooring buoy.

Connection is restored by pulling line 7. Through the centering effect of projection 25 and receiving entry 24 mooring buoy 9 will be positioned exactly opposite to receiving member 21. Through downward movement of actuating ring 28 by plunger 27 latching finger 31 is tilted back enclosing both circumferential ribs 33 and 34. This is only realized after piston 36 has moved downwardly to define the annular position of both members 9 and 21. After ring 28 has been moved to lock circumferential ribs 33 and 34 together sleeve 37 is pressurized through line 41 to provide sealing contact between face 40 and passage 19.

Figure 5:
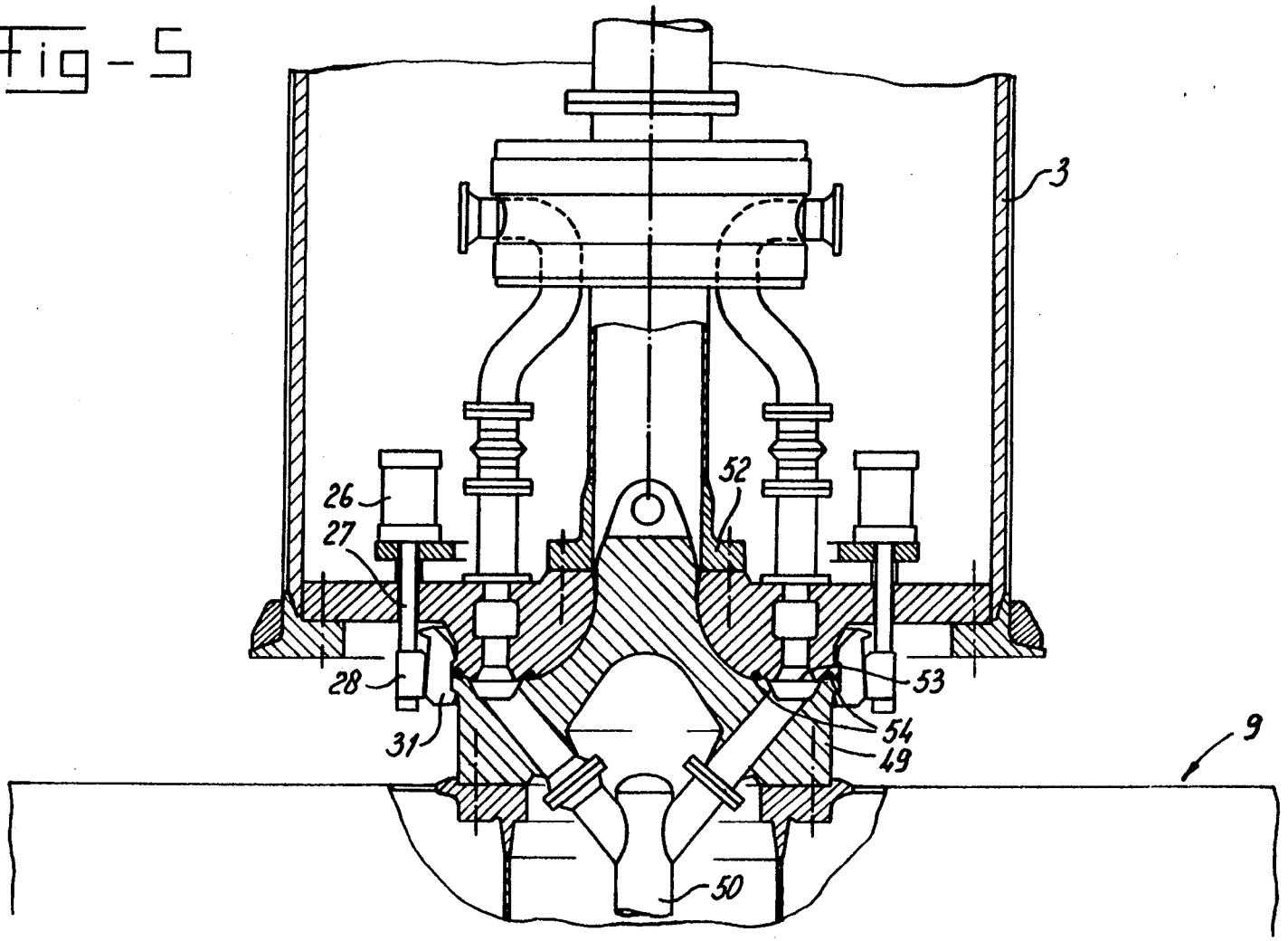
FIG. 5 is a further embodiment of the disconnectable mooring system according to the invention.

In FIG. 5 a further and somewhat simplified embodiment is shown in which the mooring buoy 49 is further simplified. This because only one fluid line or one set of fluid lines transporting the same fluid 50 originates from the sea bottom. Between the mooring buoy 49 and receiving member 52 a circular fluid path 53 is defined. Sealing is realized with O-rings 54 at both sides of groove 53. The angular position of the mooring buoy relative to the receiving member is not of any importance here. The same connect-disconnect latching fingers actuating member structure is used as in the previous embodiments.

It is of course possible that several concentric fluid paths are provided for different kinds of fluid.

Figure 6:
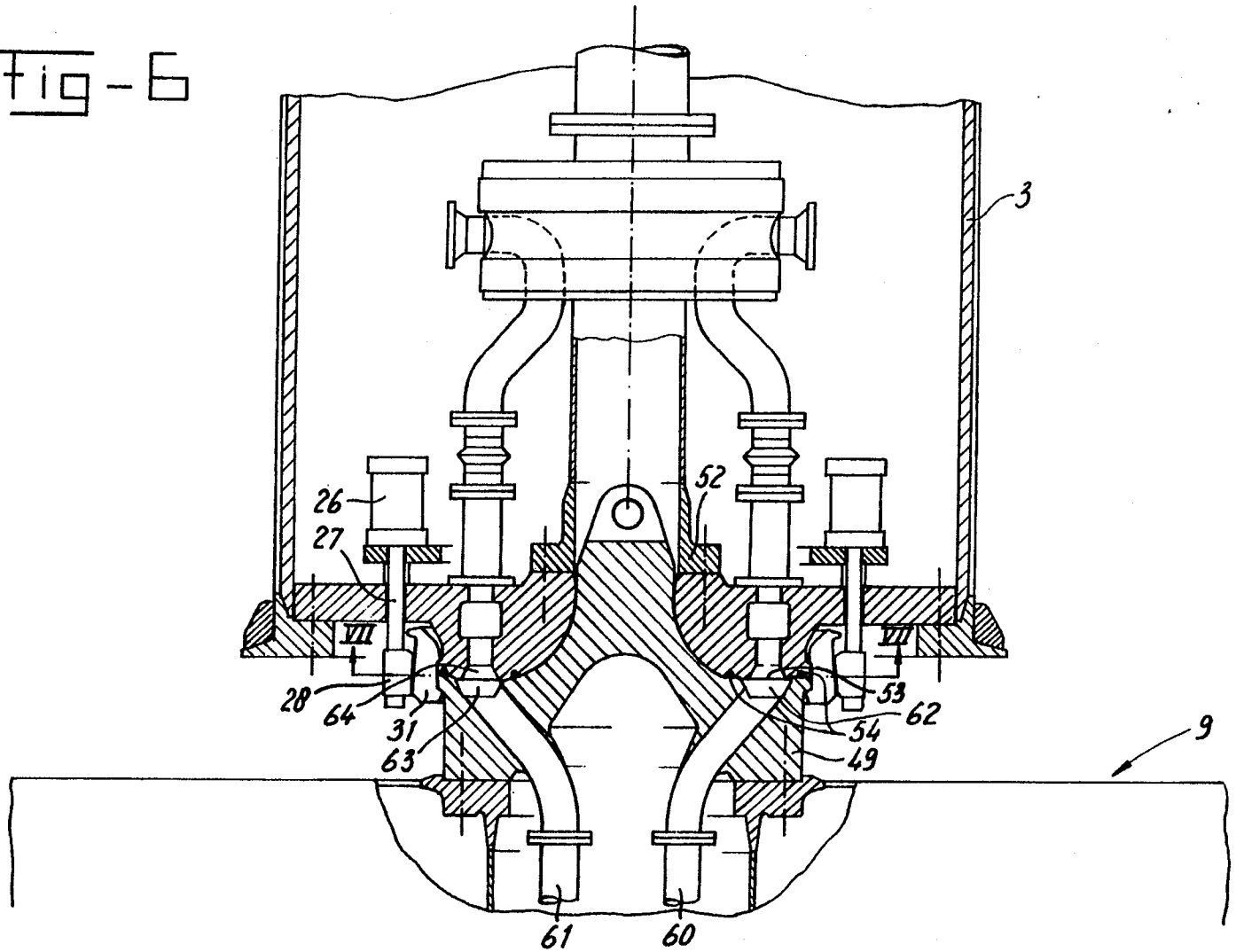
FIG. 6 is a cross section of a further embodiment of the disconnectable mooring system according to the invention, and FIG. 7 a cross section according to line VII—VII in FIG. 6.
Figure 7:
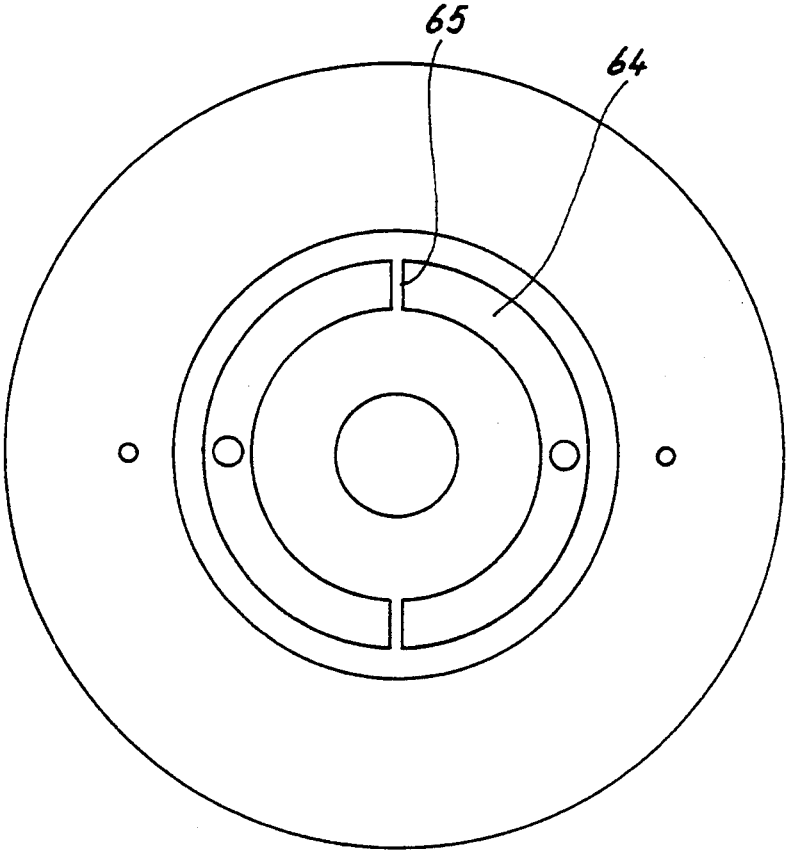

The embodiments according to FIGS. 6 and 7 correspond in many regards with the embodiment according to FIG. 5. However, there is not a single fluid line 50 but two separate lines 60 and 61 are used which can transfer different fluids. To prevent mixing there are no longer two opposed aligned grooves at the two sides of the sealing interface. In this embodiment conduits 60 and 61 end in openings 62, 63 respectively. The aligned part of the receiving member is, however, embodied as circular groove 64 being provided with two sealing baffles 65 as is clear from FIG. 7. This means that the position of mooring buoy 9 relative to the receiving member is not critical within a range of about 360°. Of course measures will be taken to prevent that baffles 65 are in front of openings 62 or 63. It is also possible to embody this device such that opening 62 or 63 can only be positioned opposite to one groove half. This means that in the positioning of the several parts is not critical within the range of about 180°.

It has to be understood that the embodiments described are preferred embodiments and that changes can be made in the details of construction as well as in the combination and arrangement of parts without departing from the spirit and scope of the invention as claimed. For instance it is possible to provide projection 25 on the receiving member and to arrange a corresponding entry in the mooring buoy.

We claim:

1. A disconnectable mooring system comprising a mooring buoy member and a receiving member, the mooring buoy member having a plurality of spaced-apart fluid passages therethrough fixedly connected to subsea fluid conduits, the receiving member having a central passageway therethrough and a plurality of fluid passages therethrough about said central passageway, fluid conduits connected to said fluid passages of said receiving member, said fluid passages of said receiving member matching in number and spacing said fluid passages of said mooring buoy member when said mooring buoy member and said receiving member are juxtaposed, lifting means connected to said mooring buoy member and extending upwardly through said central passage of said receiving member to raise said mooring buoy thereby to juxtapose said mooring buoy member and said receiving member, and sealing members surrounding said passages and sealing between said mooring buoy member and said receiving member when said mooring buoy member and said receiving member are juxtaposed.

2. A disconnectable mooring system according to claim 1, wherein the receiving member is rotatably connected to a floating structure.

3. A disconnectable mooring system according to claim 1, wherein structural connection means are provided between the mooring buoy member and the receiving member and comprise circumferential ribs of sealing faces of both the receiving member and the mooring buoy member, tiltable latching fingers having a groove to receive both circumferential ribs and actuation members for said fingers.

4. A disconnectable mooring system according to claim 1, wherein structural connection means are provided between the mooring buoy member and the receiving member and comprise a ring-shaped actuation member engaging circumferentially arranged latching members.

5. A disconnectable mooring system according to claim 4, wherein further centering means are provided, such that in only one rotational position the receiving member and mooring buoy member can be connected.

6. A disconnectable mooring system according to claim 1, wherein the receiving member is rotatably connected to a floating structure, and cooperating centering means on both the receiving member and the mooring buoy member, wherein sealing faces of both the receiving member and the mooring buoy member are flat and substantially perpendicular to the axis of the connect-disconnect movement of the members.

7. A disconnectable mooring system according to claim 6, wherein the receiving member is provided in each fluid passage with a sleeve member being displaceable in the direction of opening of the fluid member and being provided with sealing means to engage the sealing face of the mooring buoy member.

* * * * *

UNITED STATES PATENT AND TRADEMARK OFFICE

CERTIFICATE OF CORRECTION

PATENT NO. : 5,363,789

DATED : November 15, 1994

INVENTOR(S) : Jean-Phillippe Rene Louis LAURES et al.

It is certified that error appears in the above—identified patent and that said Letters Patent is hereby corrected as shown below:

On the title page:

In Item [19], change the first inventor's surname from "Laurie" to --Laures--.

In Item [75], change the first inventor's name from "Jean-Phillippe R. L. Laurie" to --Jean-Phillippe R. L. Laures--.

Signed and Sealed this

Twenty-eight Day of February, 1995

*Attest:*

*Attesting Officer*

Bruce Lehman

BRUCE LEHMAN

*Commissioner of Patents and Trademarks*